US007360873B2

(12) United States Patent
Sekiya

(10) Patent No.: US 7,360,873 B2
(45) Date of Patent: *Apr. 22, 2008

(54) COLOR INKJET RECORDING APPARATUS AND COPIER WITH INCREASED RELIABILITY

(75) Inventor: Takuro Sekiya, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/726,182

(22) Filed: Mar. 20, 2007

(65) Prior Publication Data

US 2007/0182789 A1 Aug. 9, 2007

Related U.S. Application Data

(63) Continuation of application No. 10/267,357, filed on Oct. 9, 2002, now Pat. No. 7,213,909.

(30) Foreign Application Priority Data

Oct. 12, 2001 (JP) ..... 2001-315893
Jul. 10, 2002 (JP) ..... 2002-200745

(51) Int. Cl.
*B41J 2/05* (2006.01)
*B41J 2/175* (2006.01)

(52) U.S. Cl. ..... 347/66; 347/85

(58) Field of Classification Search ..... 347/37, 347/66, 85

See application file for complete search history.

(56) References Cited

U.S. PATENT DOCUMENTS 5,293,182 A 3/1994 Sekiya et al.
5,420,618 A 5/1995 Sekiya et al.
5,539,436 A 7/1996 Wilson et al.
5,610,637 A 3/1997 Sekiya et al.
5,657,060 A 8/1997 Sekiya et al.
5,709,976 A 1/1998 Malhotra
5,729,257 A 3/1998 Sekiya et al.
5,754,202 A 5/1998 Sekiya et al.
5,877,786 A 3/1999 Sekiya et al.
6,039,425 A 3/2000 Sekiya et al.
6,174,045 B1 1/2001 Kerr et al.
6,193,348 B1 2/2001 Sekiya et al.

(Continued)

FOREIGN PATENT DOCUMENTS

JP 2-82558 6/1990
JP 3-234651 10/1991
JP 6-143743 5/1994
JP 6-328677 11/1994
JP 8-142320 6/1996

(Continued)

OTHER PUBLICATIONS

May 8, 2007 official action in connection with Japanese Patent Application No. 2002-200745.

*Primary Examiner*—An H. Do
(74) *Attorney, Agent, or Firm*—Cooper & Dunham, LLP

(57) ABSTRACT

A color inkjet recording apparatus includes a plurality of multi-nozzle inkjet recording heads ejecting inks of respective colors, supplied from an ink container provided below the multi-nozzle inkjet recording heads, a separation part separating the color inkjet recording apparatus into a first region in which the ink container is provided and a second region in which the rest or the color inkjet recording apparats is provided, and a holding part configured to hold the ink container, the holding part including a plurality of separation parts.

6 Claims, 10 Drawing Sheets

U.S. PATENT DOCUMENTS

| | | | |
|---|---|---|---|
| 6,227,639 | B1 | 5/2001 | Sekiya et al. |
| 6,270,185 | B1 | 8/2001 | Askeland |
| 6,338,545 | B1 | 1/2002 | Sekiya |
| 6,554,401 | B2 | 4/2003 | Sekiya |
| 6,568,778 | B1 | 5/2003 | Sekiya et al. |
| 6,598,959 | B2 | 7/2003 | Sekiya |
| 6,764,174 | B2 | 7/2004 | Sekiya |
| 6,857,724 | B2 | 2/2005 | Silverbrook |
| 6,871,940 | B2 | 3/2005 | Sekiya |
| 6,975,663 | B2 | 12/2005 | Sekiya et al. |
| 6,992,433 | B2 | 1/2006 | Sekiya |
| 2002/0122098 | A1 | 9/2002 | Sekiya |

FOREIGN PATENT DOCUMENTS

| | | |
|---|---|---|
| JP | 10-6488 | 1/1998 |
| JP | 10-138510 | 5/1998 |
| JP | 10-138521 | 5/1998 |
| JP | 10-146988 | 6/1998 |
| JP | 10-146989 | 6/1998 |
| JP | 11-188895 | 7/1999 |
| JP | 2000-272104 | 10/2000 |
| JP | 2001-61025 | 3/2001 |
| JP | 2001-162838 | 6/2001 |
| JP | 2001-179953 | 7/2001 |
| JP | 2001-217995 | 8/2001 |
| JP | 2001-270128 | 10/2001 |

COLOR INKJET RECORDING APPARATUS AND COPIER WITH INCREASED RELIABILITY

CROSS-REFERENCE TO RELATED APPLICATION

This application is a Rule 1.53(b) Continuation of U.S. Ser. No. 10/267,357, filed Oct. 9, 2002, now U.S. Pat. No. 7,213,909 the entire contents of which are incorporated by reference herein.

BACKGROUND OF THE INVENTION

1. Field of the Invention

The present invention generally relates to color inkjet recording apparatuses and copiers, and more particularly to a color inkjet recording apparatus and copier including a multi-nozzle inkjet recording head having a plurality of ink ejection openings formed thereon to cover the entire width of a recording medium.

2. Description of the Related Art

Inkjet recording apparatuses performing recording by jetting out ink onto the recording surface of a recording medium and having the ink adhere thereto are widely used. Generally, the inkjet recording apparatuses include a recording head having a face on which are formed openings for jetting out or ejecting ink onto the recording surface of the recording medium (such openings are hereinafter referred to as ink ejection openings and such a face is hereinafter referred to as ink ejection face).

The recording head jets out ink droplets onto the recording surface of the recording medium through the ink ejection face, the ink droplets being formed, for instance, by the pressure of electromechanical transducers or the heating energy of electro-thermal transducers controlled based on a drive control signal supplied in accordance with image data. In some recording heads, for instance, the ink ejection openings, totaling up to tens to hundreds in number in some cases, are arranged on the ink ejection face with relatively high densities of 400 to 600 dpi for high-quality and high-speed recording. In recent years, studies have been made on a so-called multi-nozzle elongated recording head, in which the ink ejection openings are formed to cover all the recording region of the recording medium, for instance, the entire width thereof, for the purpose of gaining higher recording speed.

Such an elongated recording head has thousands to tens of thousands of ink ejection openings (nozzles and orifices), and consumes substantially more ink than the conventional recording head with tens to hundreds of ink ejection openings. The development of the elongated recording head using a large amount of ink has just started. Therefore, ink supply means for the elongated recording head, for instance, includes points that have yet to be studied and made clear, so that the elongated recording head is not yet established as an inkjet recording technology. Particularly, the safety problem of the entire apparatus using the elongated recording head in the case of the occurrence of an unexpected accident should be solved in the future. Since the elongated recording head uses a large amount of ink, the inkjet recording apparatus using the elongated recording head may have damage or failure due to ink leakage.

SUMMARY OF THE INVENTION

Accordingly, it is a general object of the present invention to provide a color inkjet recording apparatus and copier in which the above-described disadvantage is eliminated.

A more specific object of the present invention is to provide a color inkjet recording apparatus and copier using a multi-nozzle inkjet recording head elongated to have a plurality of ink ejection openings so as to cover the print width of a recording medium, the color inkjet recording apparatus and copier including a good transfer system for a large amount of ink and preventing ink used therein from causing serious problems even if ink leakage should occur accidentally.

The above objects of the present invention are achieved by a color inkjet recording apparatus performing recording by ejecting ink droplets on a recording medium, the color inkjet recording apparatus including: a plurality of multi-nozzle inkjet recording heads ejecting inks of respective colors, the multi-nozzle inkjet recording heads each being elongated to cover a print width of the recording medium; an electrical system unit controlling an operation of the color inkjet recording apparatus; and an ink container connected to the multi-nozzle inkjet recording heads, the ink container being provided below the multi-nozzle inkjet recording heads and the electrical system unit.

According to the above-described color inkjet recording apparatus, the electrical system unit, which is vulnerable to water, is provided above the ink container. Therefore, if ink should leak accidentally from the ink container, the ink is prevented from damaging the electrical system unit of the recording apparatus. Therefore, the color inkjet recording apparatus can demonstrate increased reliability.

Additionally, the color inkjet recording apparatus may include a pump pumping the inks from the ink container to the multi-nozzle inkjet recording heads.

Thereby, the inks can be transferred suitably from the ink container to the multi-nozzle inkjet recording heads although the ink container is provided below the multi-nozzle inkjet recording heads.

The above objects of the present invention are also achieved by a color inkjet copier including a scanner part reading an image of an original placed on an original table and forming data on the image, a recording part performing recording on a recording surface of a recording medium based on the data on the image supplied from the scanner part, and a conveying part conveying the recording medium to the recording part in predetermined timing, wherein the recording part includes: a plurality of multi-nozzle inkjet recording heads ejecting inks of respective colors, the multi-nozzle inkjet recording heads each being elongated to cover a print width of the recording medium and provided below the scanner part; and an ink container connected to the multi-nozzle inkjet recording heads, the ink container being provided below the multi-nozzle inkjet recording heads and the scanner part.

According to the above-described color inkjet copier, the scanner part, which is vulnerable to water, is provided above the multi-nozzle inkjet recording heads and the ink container. Therefore, if ink should leak accidentally from the ink container, the ink is prevented from damaging the scanner part of the copier. Therefore, the color inkjet copier can have increased long-term reliability.

Additionally, the color inkjet copier may include a pump pumping the inks from the ink container to the multi-nozzle inkjet recording heads.

Thereby, the inks can be transferred suitably from the ink container to the multi-nozzle inkjet recording heads although the ink container is provided below the multi-nozzle inkjet recording heads.

The above objects of the present invention are also achieved by a color inkjet recording apparatus including a plurality of multi-nozzle inkjet recording heads each being elongated to cover a width of a recording medium, wherein each recording head has thousands to tens of thousands of heating elements and nozzles corresponding thereto arranged with densities of 400 to 2400 dpi, the multi-nozzle inkjet recording heads each ejecting ink on demand at frequencies of a few to 30 kHz per nozzle, the multi-nozzle inkjet recording heads being arranged and fixed so as to eject a plurality of color inks supplied from an ink container, wherein the recording medium includes a surface on which recording is performed and has the surface coated with particulate matter, and the recording is performed by conveying the recording medium to a position that opposes surfaces of the multi-nozzle inkjet recording heads which surfaces include the nozzles and ejecting ink droplets from the nozzles onto the surface of the recording medium.

The above objects of the present invention are also achieved by a color inkjet recording apparatus including: a plurality of multi-nozzle inkjet recording heads each being elongated to cover a width of a recording medium, wherein each recording head has thousands to tens of thousands of heating elements and nozzles corresponding thereto arranged with densities of 400 to 2400 dpi, the multi-nozzle inkjet recording heads each ejecting ink on demand at frequencies of a few to 30 kHz per nozzle, the multi-nozzle inkjet recording heads being arranged and fixed so as to eject a plurality of color inks; and an ink container supplying the color inks to the multi-nozzle inkjet recording heads, the ink container being provided below the multi-nozzle inkjet recording heads to be connected thereto through a communication part, wherein recording is performed on a surface of the recording medium by conveying the recording medium to a position that is above the ink container and opposes surfaces of the multi-nozzle inkjet recording heads which surfaces include the nozzles and ejecting ink droplets from the nozzles onto the surface of the recording medium.

The above objects of the present invention are also achieved by a color inkjet recording apparatus including: a plurality of multi-nozzle inkjet recording heads each being elongated to cover a width of a recording medium, wherein each recording head has thousands to tens of thousands of heating elements and nozzles corresponding thereto arranged with densities of 400 to 2400 dpi, the multi-nozzle inkjet recording heads each ejecting ink on demand at frequencies of a few to 30 kHz per nozzle, the multi-nozzle inkjet recording heads being arranged and fixed so as to eject a plurality of color inks; an ink container including a plurality of independent ink containers and supplying the color inks to the multi-nozzle inkjet recording heads, the ink container being provided below the multi-nozzle inkjet recording heads to be connected thereto through a communication part; and a separation and holding part holding the ink container so that the independent ink containers thereof are separated from each other, wherein the color inks are yellow, magenta, and cyan inks, the multi-nozzle inkjet recording heads and the independent ink containers of the ink container are arranged in an order of yellow, magenta, and cyan in terms of ink color, respectively, and recording is performed on a surface of the recording medium by conveying the recording medium to a position that is above the ink container and opposes surfaces of the multi-nozzle inkjet recording heads which surfaces include the nozzles and ejecting ink droplets from the nozzles onto the surface of the recording medium.

The above objects of the present invention are also achieved by a color inkjet recording apparatus including: a plurality of multi-nozzle inkjet recording heads each being elongated to cover a width of a recording medium, wherein each recording head has thousands to tens of thousands of heating elements and nozzles corresponding thereto arranged with densities of 400 to 2400 dpi, the multi-nozzle inkjet recording heads each ejecting ink on demand at frequencies of a few to 30 kHz per nozzle, the multi-nozzle inkjet recording heads being arranged and fixed so as to eject a plurality of color inks; an ink container including a plurality of independent ink containers and supplying the color inks to the multi-nozzle inkjet recording heads, the ink container being provided below the multi-nozzle inkjet recording heads to be connected thereto through a communication part; and a separation and holding part holding the ink container so that the independent ink containers thereof are separated from each other, wherein the color inks are yellow, magenta, cyan, and black inks, any of the independent ink containers of the ink container is replaced or supplied with ink by opening and closing a sidewall of part of the color inkjet recording apparatus in which part the ink container is provided, and recording is performed on a surface of the recording medium by conveying the recording medium to a position that is above the ink container and opposes surfaces of the multi-nozzle inkjet recording heads which surfaces include the nozzles and ejecting ink droplets from the nozzles onto the surface of the recording medium.

The above objects of the present invention are also achieved by a color inkjet recording apparatus including: a plurality of multi-nozzle inkjet recording heads each being elongated to cover a width of a recording medium, wherein each recording head has thousands to tens of thousands of heating elements and nozzles corresponding thereto arranged with densities of 400 to 2400 dpi, the multi-nozzle inkjet recording heads each ejecting ink on demand at frequencies of a few to 30 kHz per nozzle, the multi-nozzle inkjet recording heads being arranged and fixed so as to eject a plurality of color inks; an ink container supplying the color inks to the multi-nozzle inkjet recording heads, the ink container being provided below the multi-nozzle inkjet recording heads to be connected thereto through a communication part; and an electrical system unit controlling an operation of the color inkjet recording apparatus, the electrical system unit being provided above the ink container, wherein recording is performed on a surface of the recording medium by conveying the recording medium to a position that opposes surfaces of the multi-nozzle inkjet recording heads which surfaces include the nozzles and ejecting ink droplets from the nozzles onto the surface of the recording medium.

The above objects of the present invention are also achieved by a color inkjet recording apparatus including: a scanner part reading an image of an original placed on an original table and successively forming image data on the original; a recording part performing recording on a surface of a recording medium by ejecting and attaching ink to the surface of the recording medium based on the image data supplied from the scanner part; and a conveying part conveying the recording medium in predetermined timing in accordance with the recording by the recording part, wherein the recording part includes a plurality of multi-nozzle inkjet recording heads each being elongated to cover a width of a recording medium, wherein each recording head has thousands to tens of thousands of heating elements and nozzles corresponding thereto arranged with densities of 400 to 2400 dpi, the multi-nozzle inkjet recording heads each ejecting ink on demand at frequencies of a few to 30 kHz per nozzle, the multi-nozzle inkjet recording heads being arranged and fixed so as to eject a plurality of color inks supplied from an ink container, the surface of the recording medium is coated with particulate matter, and the recording medium is conveyed, at the time of the recording, to a position that opposes surfaces of the multi-nozzle inkjet recording heads which surfaces include the nozzles so that ink droplets are ejected from the nozzles onto the surface of the recording medium.

The above objects of the present invention are further achieved by a color inkjet recording apparatus including: a scanner part reading an image of an original placed on an original table and successively forming image data on the original; a recording part performing recording on a surface of a recording medium by ejecting and attaching ink to the surface of the recording medium based on the image data supplied from the scanner part, the recording part including a plurality of multi-nozzle inkjet recording heads each being elongated to cover a width of a recording medium, wherein each recording head has thousands to tens of thousands of heating elements and nozzles corresponding thereto arranged with densities of 400 to 2400 dpi, the multi-nozzle inkjet recording heads each ejecting ink on demand at frequencies of a few to 30 kHz per nozzle, the multi-nozzle inkjet recording heads being arranged and fixed below the scanner part so as to eject a plurality of color inks; a conveying part conveying the recording medium in predetermined timing in accordance with the recording by the recording part; and an ink container supplying the color inks to the multi-nozzle inkjet recording heads, the ink container being provided below the multi-nozzle inkjet recording heads to be connected thereto through a communication part, wherein, at the time of the recording, the recording medium is conveyed to a position that opposes surfaces of the multi-nozzle inkjet recording heads which surfaces include the nozzles so that ink droplets are ejected from the nozzles onto the surface of the recording medium.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description will now be given, with reference to the accompanying drawings, of an embodiment of the present invention.

Figure 1:
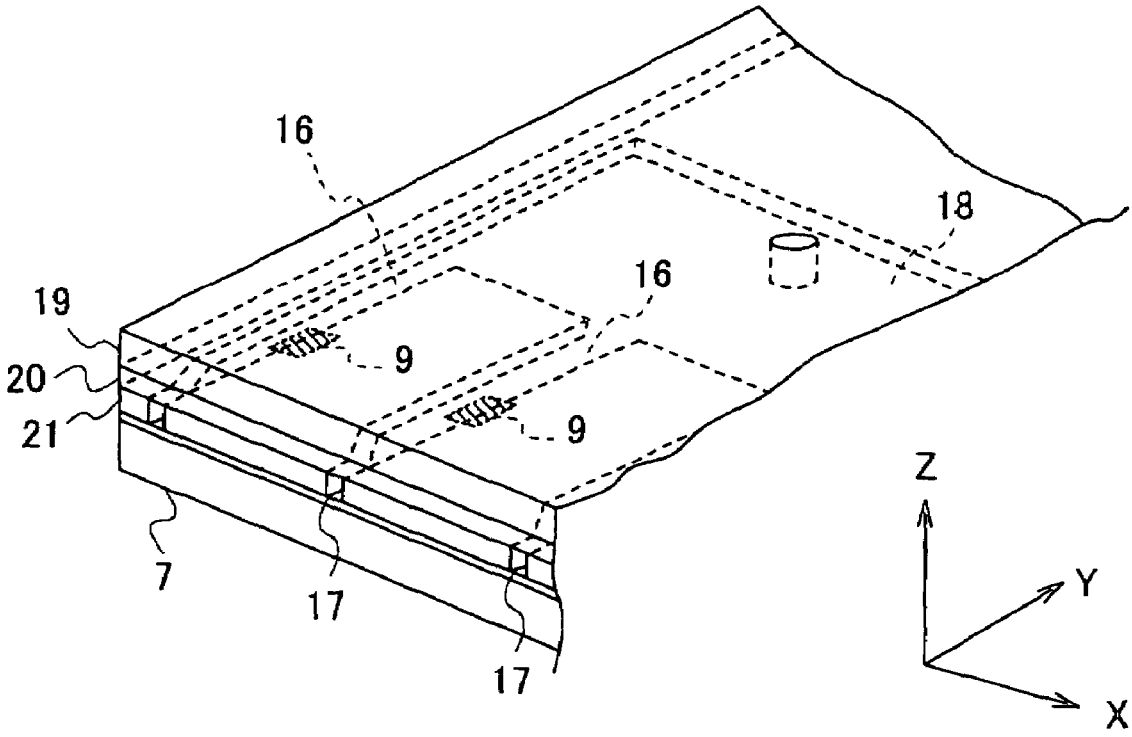
FIG. 1 is a perspective view of part of a multi-nozzle inkjet recording head used in a color inkjet recording apparatus according to the present invention.

FIG. 1 is a perspective view of part of a multi-nozzle inkjet recording head used in an inkjet recording apparatus according to the present invention. The inkjet recording head of FIG. 1 has a thermal inkjet structure that can easily realize high-density nozzle arrangements of 400 to 2400 dpi, but may employ another structure.

The inkjet recording head of FIG. 1 includes channels 16, nozzles 17, a common liquid chamber 18, a ceiling board 19, a joining layer 20, and channel barriers 21. The part of the inkjet recording head shown in FIG. 1 corresponds to only three of the nozzles 17 thereof. However, as will be described later, the inkjet recording head of FIG. 1 is actually a multi-nozzle inkjet recording head elongated so as to cover part of the width of a recording medium on which part printing is performed (this part of the width of the recording medium is hereinafter referred to as the print width of the recording medium), and the nozzles 17 totaling up to thousands to tens of thousands in number are arranged along the X-axis in FIG. 1.

Figure 2A:
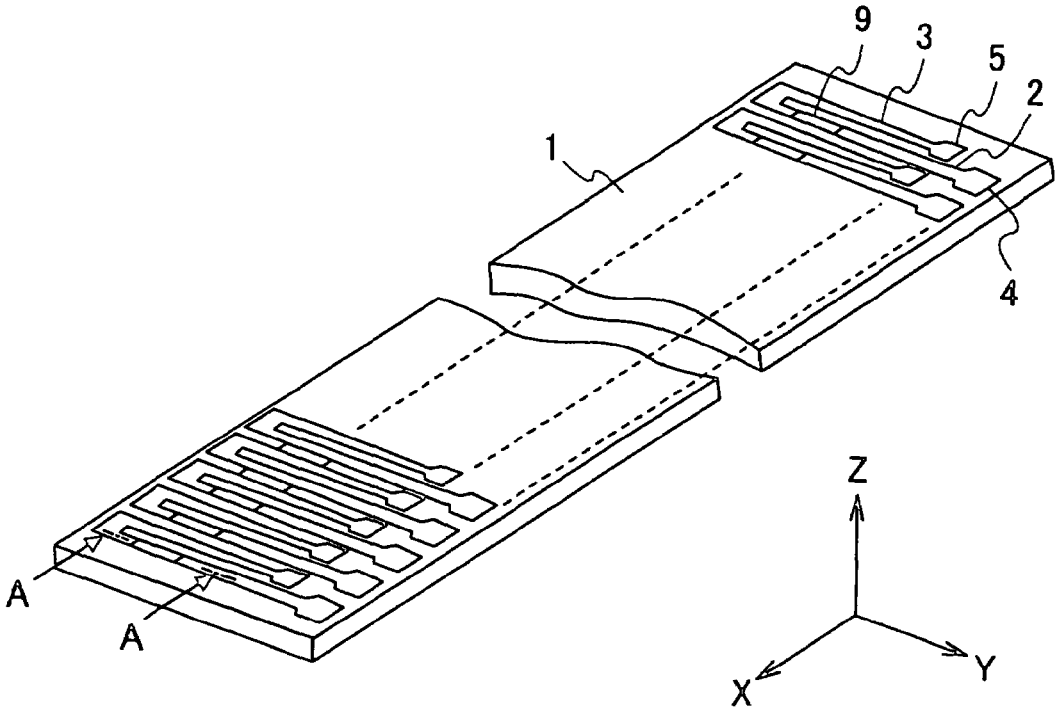
FIGS. 2A and 2B are diagrams for illustrating a heating element substrate used in the multi-nozzle inkjet recording head of FIG. 1 according to the present invention.
Figure 2B:
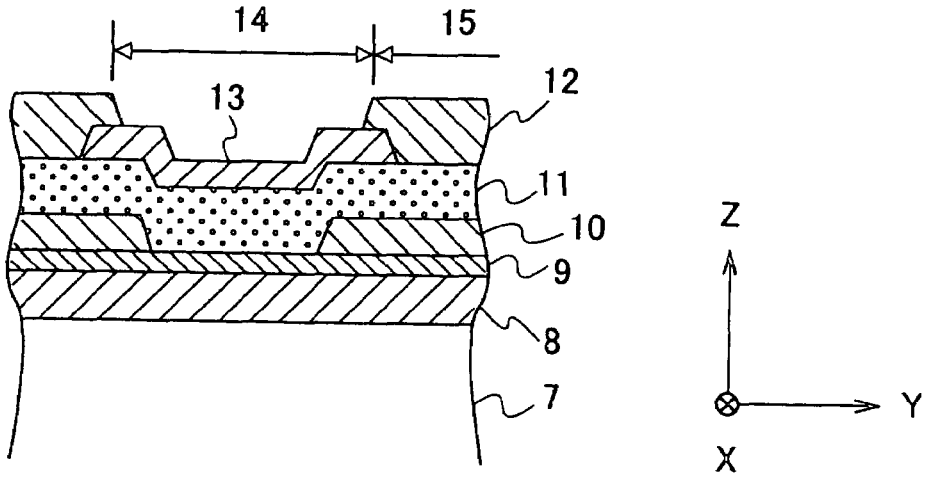

FIG. 2A is a perspective view of a heating element substrate 1 used in the thermal inkjet recording head of FIG. 1. FIG. 2B is a cross sectional view of the heating element substrate 1 taken along the line A-A of FIG. 2A when viewed in the direction indicated by the arrows A.

As shown in FIG. 2B, the heating element substrate 1 is formed by successively forming a heat storage layer ($SiO_2$) 8, heating elements ($HfB_2$) 9, electrodes (Al) 10, a protection layer ($SiO_2$) 11, an electrode protection layer (resin) 12, and another protection layer 13 on a ceramic (alumina, for instance), glass, or Si substrate 7 by a thin film formation technology such as sputtering and a pattern formation technology such as photoetching with heating parts 14 and electrode parts 15 being formed on the surface part of the heating element substrate 1. FIG. 2B shows one of the heating elements 9 and its periphery in detail.

FIG. 2A shows only the heating parts 14 and the electrode parts 15 that are important parts for the purpose of simplification. As shown in FIG. 2A, the heating elements 9 are connected to respective first electrodes (control electrodes) 2 and second electrodes (ground electrodes) 3. Each of the first electrodes 2 has a bonding pad 4 on one end thereof, and each of the second electrodes 3 has a bonding pad 5 on one end thereof. The bonding pads 4 and 5 are connected to an image information input part (not shown in the drawing), so that the heating elements 9 are drivable independently of one another. The second electrodes 3 may be replaced by one or more electrodes each used in common between two or more of the heating elements 9, that is, the first electrodes 2.

Further, the heating elements 9 may be matrix-driven instead of being driven independently of one another as in this embodiment. The heating elements 9 are arranged with densities of 400 to 2400 dpi and total up to thousands to tens of thousands in number depending on the print width of the recording medium.

The heat storage layer 8 is formed on the substrate 7 in order to prevent heat generated in the heating elements 9 from escaping toward the substrate 7. That is, the heat storage layer 8 is provided for efficiently communicating the generated heat to ink so that air bubbles can be generated stably in the ink. Normally, $SiO_2$ is used for the heat storage layer 8. $SiO_2$ is formed into a film of 1 to 5 μm in thickness by a film formation technology such as sputtering.

As shown in FIG. 2B, the layer of the heating elements 9 is formed on the $SiO_2$ heat storage layer 8. Any of a tantalum-$SiO_2$ compound, tantalum nitride, nichrome, a silver-palladium alloy, a silicon semiconductor, and borides of metals such as hafnium, lanthanum, zirconium, titan, tantalum, tungsten, molybdenum, niobium, chromium, and vanadium is useful as a material for the heating elements 9. The metal boride having the best characteristic is hafnium boride ($HfB_2$), followed by zirconium boride, lanthanum boride, tantalum boride, vanadium boride, and niobium boride in the order described.

The heating elements 9 can be formed of any of the above-described materials by electron beam deposition or sputtering. The film thickness of each of the heating elements 9 is determined based on its area and material, the shape and size of its heating part, and its actual power consumption so that a desired heating value per unit time can be obtained. Normally, the film thickness is 0.001 to 5 μm, preferably, 0.01 to 1 μm.

According to the embodiment of the present invention, a $HfB_2$ film of 2000 Å (0.2 μm) in thickness is formed by sputtering.

Many normally used electrode materials such as Al, Ag, Au, Pt, and Cu can be used effectively as materials for the electrodes 10. By using any of these materials, the electrodes 10 are formed at predetermined positions by a method such as deposition so as to have a predetermined size, shape, and thickness. According to this embodiment of the present invention, the electrodes 10 are formed of Al by sputtering to have a thickness of 1.4 μm.

The protective layer 11 is required to have characteristics such as corrosion resistance against ink, protection from impact due to the disappearance of air bubbles (cavitation resistance), effective transfer of heat generated in the heating elements 9 to a sheet of heat sensitive paper, ink ribbon, and ink that is a liquid for recording.

Useful materials for the protective layer 11 include silicon oxide, silicon nitride, magnesium oxide, aluminum oxide, tantalum oxide, and zirconium oxide, for instance. The protective layer 11 can be formed of any of these materials by a method such as electron beam deposition or sputtering. Further, ceramic material such as silicon carbide or aluminum oxide (alumina) is also suitable for the protective layer 11.

It is desirable that the film thickness of the protective layer 11 be set normally to 0.01 to 10 μm, preferably to 0.1 to 5 μm, and most preferably to 0.1 to 3 μm. In this embodiment of the present invention, the protective layer 11 is formed of $SiO_2$ by sputtering so as to have a thickness of 1.2 μm.

The electrode protective layer 12 shown in FIG. 2B is a resin layer of 2 μm in thickness. The electrode protective layer 12 is formed as required. However, the electrode protective layer 12 is not always required and is omittable. As a material for the protective layer 13 shown in FIG. 2B, tantalum (Ta) is suitably employed in consideration of its cavitation resistance. Cavitation impact due to the generation of air bubbles is applied to the heating element regions. Therefore, by forming the Ta protective layer 13 of 4000 Å by sputtering in order to protect the heating element regions from being damaged, the inkjet recording head is provided with good performance.

The inkjet recording head of the present invention can be formed by using the above-described heating element substrate 1. Specifically, the inkjet recording head of the present invention can be manufactured in a process as shown in FIGS. 3A through 3F.

FIGS. 3A through 3F are diagrams showing a process of manufacturing the inkjet recording head according to the present invention. For convenience of description, the heat storage layer 8, the electrodes 10, the electrode protection layer 12, and the protection layer 13 are omitted in FIGS. 3A through 3F.

Figure 3A:
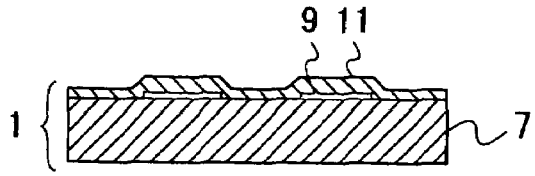
FIGS. 3A through 3F are diagrams for illustrating a process of manufacturing the multi-nozzle inkjet recording head of FIG. 1 according to the present invention.

(a) First, the heating element substrate 1 is prepared as shown in FIG. 3A. The heating element substrate 1 has the heating elements 9 and the protective layer 11 formed on the substrate 7. The protective layer 11 is formed of a thin film protecting and insulating the heating elements 9.

Figure 3B:
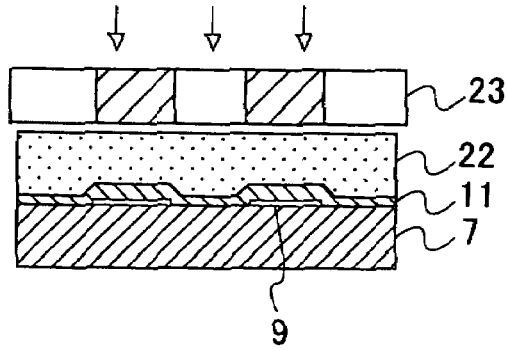

(b) The heating element substrate 1 is coated with a photoresist 22 as shown in FIG. 3B. The heating element substrate 1 shown in FIG. 3A is coated with the photoresist 22 of 1000 to 2000 cP (centipoises) in viscosity and 5 to 30 μm in thickness by spin coating, dip coating, or roller coating. The thickness of the photoresist 22 finally becomes the height of the channel barriers 21, which height varies depending on the arrangement density (print density) of the heating elements 9. If the photoresist 22 is desired to be more than or equal to 20 μm in thickness, a dry film photoresist may be used instead of a liquid photoresist. Then, as shown in FIG. 3B, a photomask 23 having a predetermined pattern is superimposed on the photoresist 22 formed on the heating element substrate 1, and thereafter, the structure of the heating element substrate 1, the photoresist 22, and the photomask 23 is exposed to light from above the photomask 23. At this point, the positions of the heating elements 9 should be aligned with the predetermined pattern of the photomask 23.

Figure 3C:
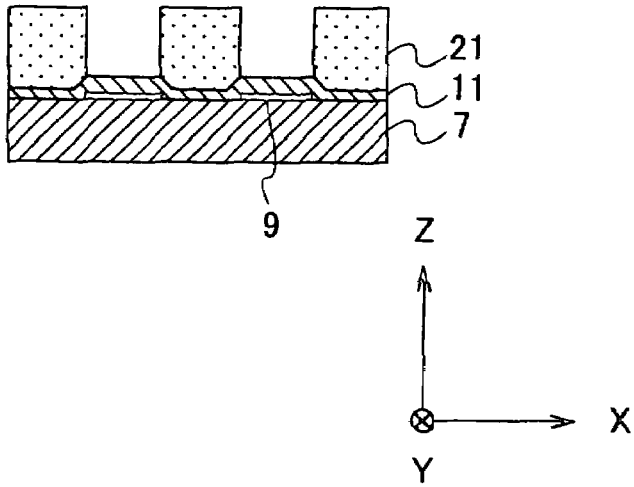

(c) The channel barriers 21 are formed as shown in FIG. 3C. The unexposed parts of the photoresist 22 subjected to the exposure are removed by an alkali developer such as a sodium carbonate aqueous solution so that the channel barriers 21 are formed. The removed parts of the photoresist 22 become concave parts including the heating elements 9, forming the channels 16 and the common liquid chamber 18.

Figure 3D:
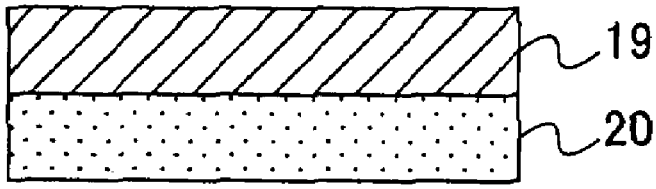

(d) A substrate that serves as a ceiling (a ceiling substrate) for the channels 16 and the common liquid chamber 18 is formed as shown in FIG. 3D. The ceiling substrate is formed by joining the joining layer 20 and a glass substrate. The glass substrate becomes the ceiling board 19.

Figure 3E:
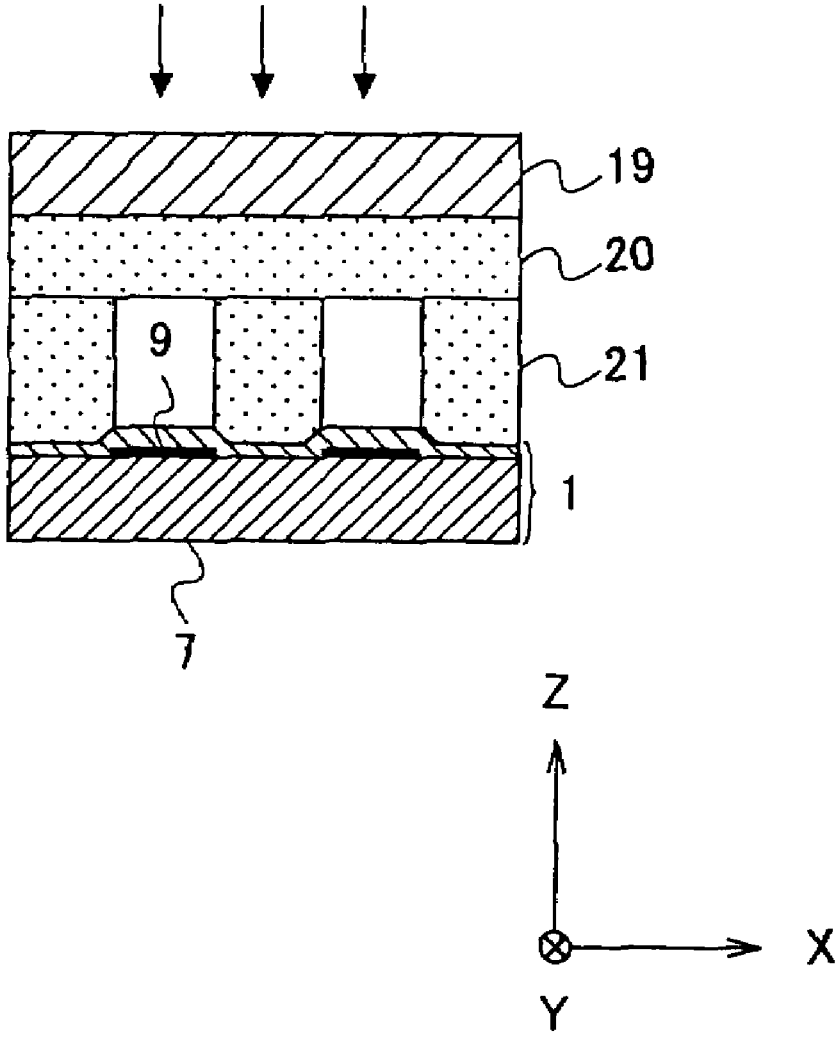

(e) The ceiling substrate is joined to the channel barriers 21 as shown in FIG. 3E. The structure of FIG. 3C and the ceiling substrate of FIG. 3D are joined with the photoresist 22 and the joining layer 20 opposing each other. At this point, the structure of FIG. 3C and the ceiling substrate of FIG. 3D are subjected to thermosetting (or heating at 150° C. to 250° C. for 30 to 60 minutes, for instance) or ultraviolet irradiation (at intensities of 50 to 200 $mW/cm^2$ or larger) so as to increase corrosion resistance against ink and their joining strength.

Figure 3F:
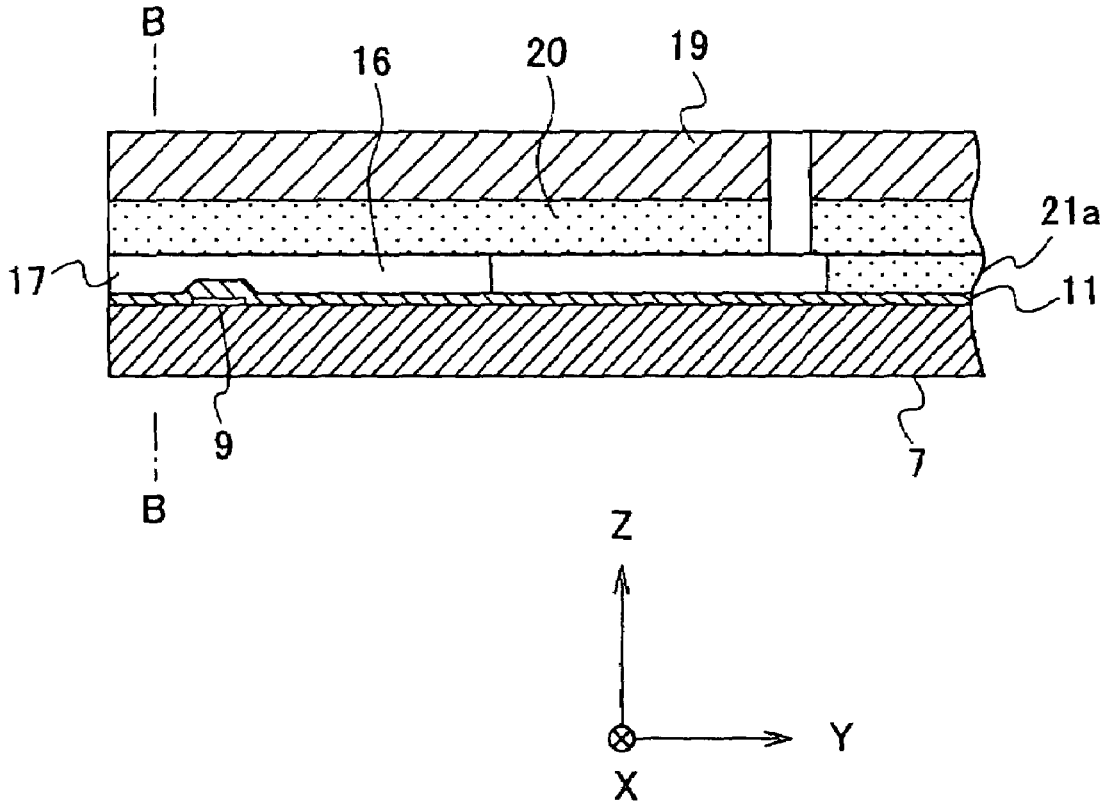
Figure 4A:
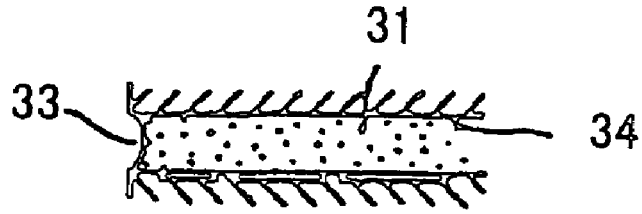
FIGS. 4A through 4G are a series of diagrams for illustrating an operation of the multi-nozzle inkjet recording head of FIG. 1 according to the present invention.
Figure 4B:
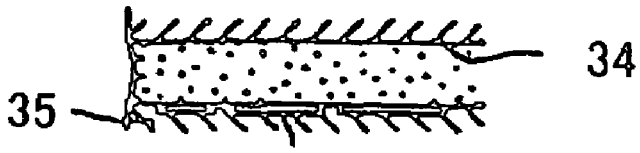
Figure 4C:
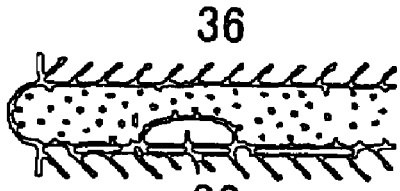
Figure 4D:
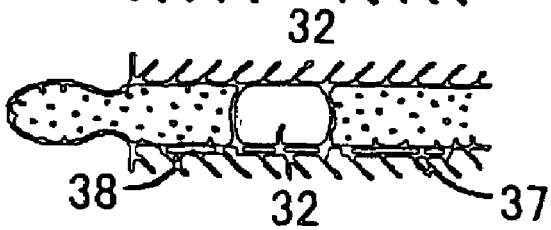
Figure 4E:
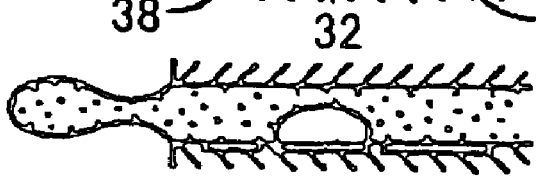
Figure 4F:
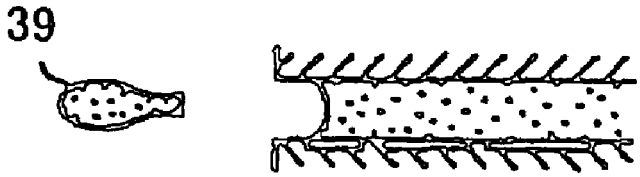
Figure 4G:
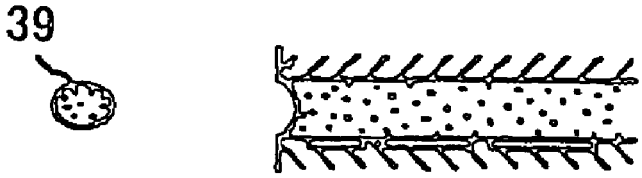

(f) The nozzles (ejection openings) 17 are formed as shown in FIG. 3F. Finally, the structure of FIG. 3F is cut, by dicing, along the line B-B close to its openings on the heating element side so that the nozzles (ejection openings) 17 are formed. Thereby, the inkjet recording head is completed. According to another method, the inkjet recording head may be manufactured by integrally forming the channels 16 and the common liquid chamber of a resin such as polysulfone, polyethersulfone, polyphenylene oxide, polypropylene, or a polyimide.

Further, the nozzles 17 may be formed suitably by providing a resin film to the ends of the channels 16 and making ejection openings by an excimer laser. In the case of using the excimer laser, the nozzles 17 can be formed in any shape according to a mask shape. Therefore, it is advantageous to use the excimer laser since the shape of the nozzles 17 can be determined to be round, polygonal, or radial (star-shaped) in consideration of the ink ejection characteristic. In this case, a resin such as polysulfone, polyethersulfone, polyphenylene oxide, polypropylene, or a polyimide can also be suitably used.

Next, a description will be given, with reference to FIGS. 4A through 4G, of a principle of ink ejection according to the above-described inkjet recording head.

FIGS. 4A through 4G are a series of diagrams showing how ink 31 is ejected from an ejection opening 33 as an ink droplet 39. When a signal pulse is input, based on image information, through a first electrode (control electrode) 37 and a second electrode (ground electrode) 38 to a heating element 36 formed on a heating element substrate 35, an air bubble 32 is generated in the ink 31 based on the input signal pulse. Then, the air bubble 32 causes part of the ink 31 in a channel 34 to be ejected from the opening 33 as the ink droplet 39 to be recorded on a recording medium such as a sheet of paper.

The duration of the signal pulse is desirably a few to ten-odd microseconds (μs), and is 30 μs at the maximum. Once the air bubble 32 is generated on the heating element 36, the air bubble 32 blocks the heat of the heating element 36 thereafter so that there is no substantial change in the size of the air bubble 32. Therefore, the signal pulse is applied for an unnecessarily long period of time in vain only to damage the heating element 36. After stopping the application of the signal pulse, the air bubble 32 is deprived of heat by the heating element substrate 35 and the surrounding ink 31 to contract and disappear. As is apparent from this description, the air bubble 32 affecting the principle of ink ejection according to the present invention is obtained by rapid heating in an extremely short period of time. The air bubble 32 is the air bubble of a phenomenon, so-called film boiling in the field of heat transfer engineering, and has very good repeatability from generation to disappearance.

According to another principle of ink ejection, the position of the heating element 36 shown in FIGS. 4A through 4G may be brought closer to the ejection opening 33 so that a finer ink droplet may be ejected, or the air bubble 32 may grow to appear from the ejection opening or explode.

The above description including that on the method of manufacturing the inkjet recording head is based on the inkjet recording head of a thermal inkjet type. However, the inkjet recording head may be of an inkjet type using piezoelectric elements.

Figure 5:
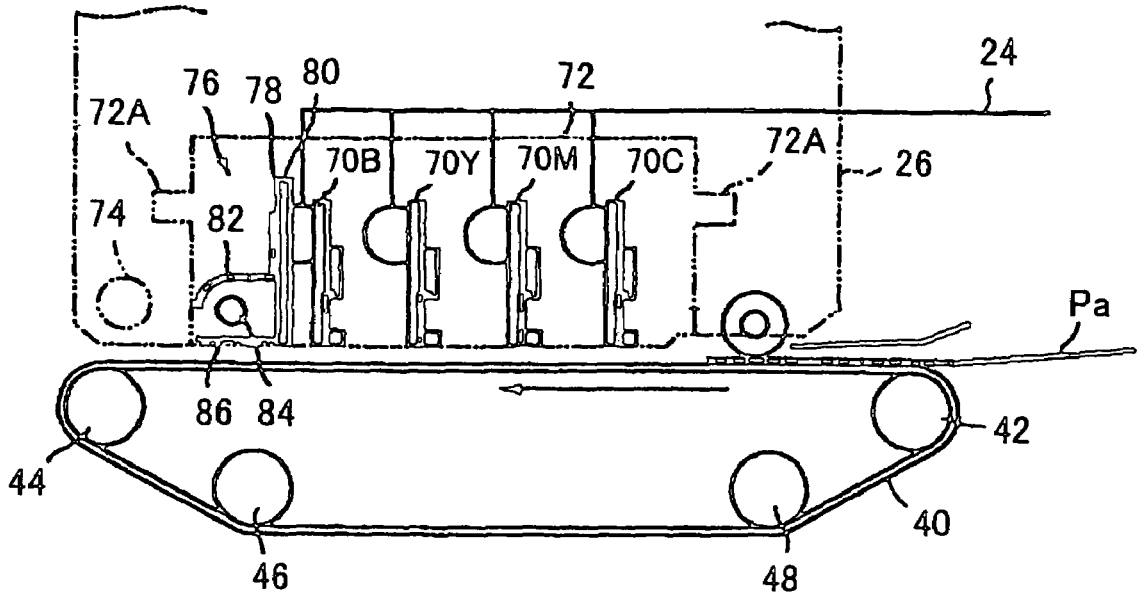
FIG. 5 is a sectional view of a recording part and its periphery of a multi-nozzle inkjet recording apparatus according to the present invention.

FIG. 5 is a diagram showing a recording part 26 of a multi-nozzle inkjet recording apparatus according to the embodiment of the present invention. In FIG. 5, reference numeral 40 indicates a conveying belt, and reference numerals 42, 44, 46, and 48 indicate rollers.

The recording part 26 includes a head block 72 containing recording heads 70C, 70M, 70Y, and 70B and a later-described heating-type fixing unit 76. Each of the recording heads 70C, 70M, 70Y, and 70B is elongated to include a plurality of ink ejection openings as the above-described inkjet recording head of the present invention so as to cover the print width of a recording medium (a paper sheet Pa). Inside the recording part 26, the head block 72 is supported through projecting parts 72A provided on both ends thereof along the conveying path of the paper sheet Pa.

The recording heads 70C, 70M, 70Y, and 70B are successively arranged at predetermined intervals from the upstream side to the downstream side of the conveying path of the paper sheet Pa. The recording heads 70C, 70M, 70Y, and 70B are positioned and fixed to the head block 72 so that a plane formed by the ink ejection surfaces of all of the recording heads 70C, 70M, 70Y, and 70B has a flatness smaller than or equal to tens of microns (μ).

The recording heads 70C, 70M, 70Y, and 70B are of the above-described thermal inkjet type, and eject ink of cyan, magenta, yellow, and black, respectively. That is, each of the recording heads 70C, 70M, 70Y, and 70B includes heaters as electro-thermal transducers in its liquid channels communicating with their respective ejection openings, and ejects ink droplets formed by heating ink with the heaters. The ejection openings of each of the recording heads 70C, 70M, 70Y, and 70B are arranged in a direction substantially perpendicular to the direction, indicated by the arrow in FIG. 5, in which the paper sheet Pa is conveyed. That is, each of the recording heads 70C, 70M, 70Y, and 70B has their ejection openings formed over its entire length in the direction perpendicular to the direction in which the paper sheet Pa is conveyed.

The recording heads 70C, 70M, 70Y, and 70B are connected to respective ink supply channels 24 (a communication part) so as to be supplied with inks of respective colors from later-described ink containers. The ink supply channels 24 of the respective colors, which are indicated by a single line in FIG. 5, are independent of one another. Corrosion resistance against ink is required of the ink supply channels 24, so that resin tubes of Teflon® or polyethylene, or stainless pipes are employed for the ink supply channels 24.

The recording heads 70C, 70M, 70Y, and 70B perform respective recording operations independently of one another on the same paper sheet Pa. For instance, the recording head 70C performs recording first on the paper sheet Pa. Next, the recording head 70M performs recording on the recorded part or another part of the paper sheet Pa. Then, the recording head 70Y performs recording on the paper sheet Pa in the same way, and finally, the recording head 70B performs recording on the paper sheet Pa.

In a color inkjet recording apparatus including inkjet recording heads of three colors of yellow, magenta, and cyan, the inkjet recording heads are arranged in the order of yellow, magenta, and cyan. At the same time, ink containers for supplying the respective color inks to the inkjet recording heads are also arranged in the order of yellow, magenta, and cyan.

The recording heads 70C, 70M, 70Y, and 70B do not necessarily eject ink, but at least one of the recording heads 70C, 70M, 70Y, and 70B may eject a process liquid for making ink insoluble, or may eject, before ink ejection, a process liquid for preventing pixels (ink) from spreading or running more than required on the paper sheet Pa, for instance.

According to this inkjet recording method, ink adhering to a material on which recording is performed (a recording material) penetrates into the recording material, so that the ink is fixed on the recording medium. Alternatively, the adhering ink is fixed on the recording material through the evaporation process of the solvent of the ink.

However, a period between the adhesion and the fixation of ink, that is, a rate at which ink is fixed (a fixing rate), depends largely not only on the configuration and the physical properties of the recording material, but also on the conditions of the external atmosphere. Further, the natural fixing rate (at which ink is naturally fixed) cannot be made higher than a certain value for a physical characteristic reason.

The rate at which the adhering ink penetrates into the recording material also varies greatly depending on the composition of the ink used.

Normally, in many cases, the composition of ink is distinguished based on the penetrability of the ink with respect to a recording material. Generally, ink having a higher penetrability has an advantage in terms of fixation because the ink penetrates into the recording material at a higher rate. However, the ink may penetrate too much into the recording material so as to run greatly thereon, thus causing the problem of deterioration in image quality. Further, the ink may penetrate deeply into the recording material, which is likely to cause a decrease in image density.

On the other hand, ink having a lower penetrability takes time in penetrating into the recording material as described above. Further, the problem of color mixture among ink colors, the problem of ink running, and the problem of rubbing on an image at the time of ejecting the recording material (a so-called problem of rubfastness) are caused in terms of fixation in the case of multi-color printing when the ink having a lower penetrability is used in an inkjet recording apparatus using multi-nozzle inkjet recording heads elongated to cover the print width of a recording medium so as to meet a demand for high-speed recording as in the present invention. Therefore, it is important to have ink fixation, image density, ink running, and friction resistance considered in the configuration of the inkjet recording apparatus.

The problem of fixation can be solved by somewhat simple configurations in many conventional serial-scan recording apparatuses because of their recording rates.

In high-speed, color recording as performed in the embodiment of the present invention, however, the below-described heating-type fixing unit 76 for reducing fixation time and increasing efficiency in fixation is required to fix the adhering ink on the recording material in a desired state.

As shown in FIG. 5, for instance, the heating-type fixing unit 76 is provided on the downstream side of the recording head 70B in the conveying path in a position relatively close and corresponding thereto. Here, the heating-type fixing unit 76 includes a halogen heater 84 as a heating part, a reflector 82 reflecting heat rays from the halogen heater 84, a heating part shielding member 86 separating the halogen heater 84 from the conveying path, and a heat insulating device 78 as a heat insulating part preventing heat transfer from the halogen heater 84 to the recording head 70B.

According to the present invention, as shown in FIG. 5, heating is performed on the printing-surface side of the paper sheet (recording medium) Pa with no contact therewith (the surface of the paper sheet Pa on which printing is performed is referred to as a printing or recording surface). That is, the printed part of the paper sheet Pa is heated from its printing-surface side, so that a volatile constituent in the ink, such as water, can be dried efficiently.

A ceramic heater may be suitably used as a heating part for fixation in the heating-type fixing unit 76.

In this embodiment, heating and drying are performed after printing. However, ink can also be dried effectively by providing any of the above-described heating parts in the conveying path at a position where the paper sheet Pa passes before printing so that printing is performed on the preheated paper sheet Pa.

Next, a description will be given of the entire configuration of a color inkjet copier to which the multi-nozzle inkjet recording heads each elongated to cover the print width of a recording medium according to the present invention are applied.

Conventionally, so-called copiers refer to those of an electrophotographic type. The electrophotographic copiers are widely used, but the complexity of the electrophotographic method makes those copiers larger in scale. On the other hand, the principle of inkjet recording is simple. Therefore, by employing the inkjet recording as a recording principle, epoch-making copiers having the simplest configuration ever can be realized.

Figure 6:
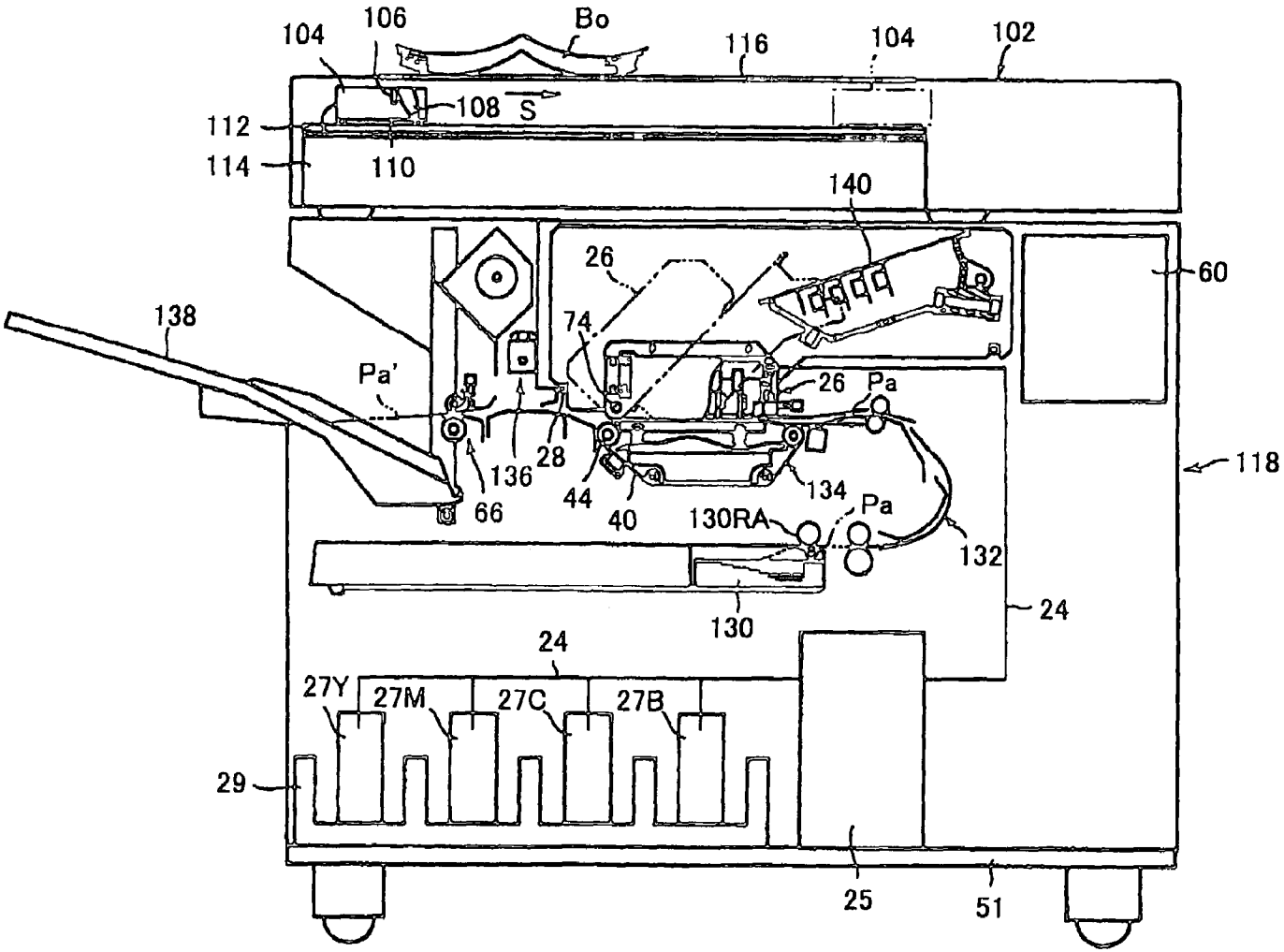
FIG. 6 is a sectional view of a color inkjet copier using the multi-nozzle inkjet recording apparatus according to the present invention.

FIG. 6 is a diagram showing the color inkjet copier according to the present invention. The color inkjet copier of FIG. 6 includes a scanner part 102 and an inkjet printer part 118. The multi-nozzle inkjet recording apparatus of the present invention may be employed as the inkjet printer part 118. The scanner part 102 successively forms image data on the original Bo placed on an original table 116 by reading the image of a surface of the original Bo to be copied. The inkjet printer part 118 includes the recording part 26, a conveying part 134, a conveying path 136 for paper ejection, a paper ejection tray 138, a paper feed part 130, a conveying part 132 for paper feed, and a recovery operation unit 140. The recording part 26 performs a recording operation by ejecting and attaching ink to the recording surface of the paper sheet Pa as a recording medium based on the image data supplied from the scanner part 102. The conveying part 134, which is provided below the recording part 26, conveys the paper sheet Pa to the conveying path 136 in predetermined timing in accordance with the recording operation of the recording part 26. The recorded or printed paper sheet Pa (indicated by Pa' in FIG. 6 for distinction from the paper sheet Pa before printing) is conveyed by the conveying part 134 to be ejected onto the paper ejection tray 138 through the conveying path 136. The conveying part 132 conveys sheets of paper one by one as the paper sheet Pa from the paper feed part 130 to the recording part 26. The recovery operation unit 140 performs a recovery operation selectively on the recording heads 70C, 70M, 70Y, and 70B of the recording part 26.

When recording is not performed, the recording part 26 is turned on a rotation shaft 74 to escape to the position indicated by the double-dot chain line in FIG. 6 so that the recovery operation unit 140, which is a reliability maintenance mechanism formed of a suction device, covers the nozzle surface of the recording part 26. Thereby, the recording part 26 is capped by the recovery operation unit 140 and is subjected to its suction operation.

In this color inkjet copier, the recording part 26, the scanner part 102, and the paper feed part 130 are driven and controlled by an electrical system unit 60. Since the electrical system unit 60 is vulnerable to water, it is desirable that the electrical system unit 60 be provided as remote as possible from moisture such as ink. In consideration of this point, the electrical system unit 60 is provided above an ink container 27 in the present invention. Thereby, even if ink leaks from the ink container 27, such an accident that the electrical system unit 60 is soaked in the ink to result in failure can be avoided.

In the color inkjet copier of FIG. 6, the electrical system unit 60 is provided above the ink container 27 and the recording part 26. That is, the basic idea of failure and accident prevention is to provide the ink container 27 containing a large amount of ink at the bottom of the color inkjet copier. Since ink may leak from the recording part 26, it is desirable that the electrical system unit 60 be provided above the recording part 26 as shown in FIG. 6. By providing the most dangerous component at the very bottom, the electrical system unit 60 is prevented from being submerged (with ink) by an unexpected accident.

As previously described, the recording part 26 includes the recording heads 70C, 70M, 70Y, and 70B ejecting inks of their respective colors. The recording heads 70C, 70M, 70Y, and 70B are supplied with their inks from a cyan ink container 27C, a magenta ink container 27M, a yellow ink container 27Y, and a black ink container 27B, respectively, of the ink container 27. The independent ink containers 27C, 27M, 27Y, and 27B are connected to the corresponding ink supply channels 24 and placed on an ink container tray 29. The ink container tray 29 includes independent barriers that separate the ink containers 27C, 27M, 27Y, and 27B from one another. In FIG. 6, the independent barriers are short. However, the independent barriers are not limited to the structure of FIG. 6, and the ink container tray 29 may have a totally independent barrier structure where the ink containers 27C, 27M, 27Y, and 27B are completely separated by the independent barriers designed to even cover the entire upper parts of the ink containers 27C, 27M, 27Y, and 27B.

When one of the ink containers 27C, 27M, 27Y, and 27B runs out of ink to be supplied with ink or replaced by another ink container, such an independent barrier structure can prevent ink spilling or overflowing from the one of the ink containers 27C, 27M, 27Y, and 27B from contaminating its surrounding part, or can prevent ink spouting out from the one of the ink containers 27C, 27M, 27Y, and 27B from contaminating an adjacent one of the ink containers 27C, 27M, 27Y, and 27B. Particularly in the case of employing the totally independent barrier structure, ink spouting out of one of the ink containers 27C, 27M, 27Y, and 27B due to an unexpected reason can be prevented from being mixed into the ink of an adjacent one of the ink containers 27C, 27M, 27Y, and 27B.

Since a large amount of ink is consumed in the present invention, it is preferable to provide a pump 25 to supply ink. In the case of using a very low recording head driving frequency (ink droplet ejection frequency) of, for instance, a few to several hundred hertz (Hz) per nozzle, ink can be supplied by a capillary action without using a pump. In the case of driving and using a recording head at a frequency of a few to 30 kHz per nozzle, however, it is necessary to supply ink to the recording head forcibly by a pump.

In the color inkjet copier of FIG. 6, the pump 25 is provided in the middle of the ink supply channels 24 connecting the recording heads 70C, 70M, 70Y, and 70B and the corresponding ink containers 27C, 27M, 27Y, and 27B. The pump 25, whose detailed structure is not graphically represented in FIG. 6, can be driven independently for each ink color so that each of the color inks can be supplied independently.

The scanner part 102 includes an original scanning unit 104, guide rails 112, and a driving part (not shown in FIG. 6). The original scanning unit 104 reads an image of the original Bo to be copied. The guide rails 112 support the original scanning unit 104 so that the original scanning unit 104 is movable in the direction indicated by the arrow S and the direction reverse thereto in FIG. 6. The driving part moves the original scanning unit 104 supported by the guide rails 112 back and forth between the positions indicated by the solid and dot-dash lines, respectively, in FIG. 6 at a predetermined rate.

The original scanning unit 104 includes, as main components, a rod array lens 106, a line sensor 110 of non-magnifying color separation as a color image sensor for reading color information, and an exposure unit 108 such as a lamp light source.

When the original scanning unit 104 is caused by the driving part to move and scan in the S direction so as to read the image of the original Bo placed on the original table 116 formed of a transparent material, an exposure lamp inside the exposure unit 108 lights up so that a reflected light from the original Bo is guided by the rod array lens 106 to be focused on the line sensor 110. The line sensor 110 reads color image information represented by the reflected light color by color, and converts the color image information to electrical digital signals. Then, the line sensor 110 supplies the electrical digital signals to the control unit (the electrical system unit 60) of the inkjet printer part 118 as image data. Accordingly, the recording heads 70C, 70M, 70Y, and 70B of the recording part 26 eject their respective liquids used for recording, that is, their respective inks of the different colors in this embodiment, in accordance with drive control pulse signals based on the image data.

In the present invention, as previously described, the scanner part 102 includes the lamp light source, which is vulnerable to water. Therefore, the above-described idea of failure and accident prevention for the electrical system unit 60 should also be applied to the scanner part 102. That is, as is apparent from FIG. 6, the scanner part 102 is provided above the ink container 27 containing a large amount of ink in the present invention. Further, the scanner part 102 is also provided above the recording part 26 ejecting ink droplets. Thereby, the scanner part 102 is prevented from being submerged (with ink) by an unexpected accident, and thus from having damage or failure resulting from the submergence.

When a driving motor (not shown in the drawing) is put into operation, the sheets of paper (Pa) of a standard size contained stacked in the paper feed part 130 are extracted one by one as the paper sheet Pa by a pickup roller unit 130RA to be supplied to the conveying part 132.

According to the inkjet recording, ink droplets are jetted out to adhere to the surface of a paper sheet for recording, so that recording is performed. Therefore, it is necessary that ink be prevented from spreading more than required to blur printing on the paper sheet Pa. Further, the paper sheet Pa is considered suitable if being characterized so as to immediately soak up ink adhering thereto. Furthermore, the paper sheet Pa is considered suitable if being characterized so that (a) no phenomenon of ink running or bleeding is observed even when inks of different colors are superimposed one over another on the same part of the paper sheet Pa in a short period of time and (b) the spreading of print dots on the paper sheet Pa is limited so as not to damage image sharpness.

Copying paper employed in electrophotographic copiers, which is called plain paper, and other widely used recording paper may not fully satisfy these characteristics. In the case of performing printing in one color or superimposing two colors on such paper, an image satisfactory to some extent in quality can be obtained in most cases. However, if the amount of ink adhering to paper is increased as in the case of printing a full-color image by superimposing inks of three colors or more, for instance, printing performed on such paper may not provide fully satisfactory image quality.

Paper having a coating of, for instance, fine particles of a silicon oxide on base paper so as to obtain the above-described characteristics may be used as paper satisfying the above-described characteristics. By using such paper coated with particulate material, ink can be absorbed faster in the depth direction of the recording medium. This contributes to faster ink drying and fixation.

According to the present invention, the color inkjet copier includes the heating-type fixing unit 76 for ink fixation that covers an area larger than the width of the printed part of a recording medium as previously described. Therefore, the color inkjet copier has a capability of fixation high enough to perform instantaneous ink drying and fixation. Accordingly, the color inkjet copier of the present invention can successively output prints and/or copies with high image quality at high speed without wet ink adhering to the reverse sides of the prints or copies (the reverse sides refer to the surfaces reverse to the printing surfaces of the prints or copies). Particularly, an inkjet copier based on the multi-nozzle inkjet principle to employ recording heads elongated to have a plurality of ink ejection openings covering the print width of a recording medium can perform printing and/or copying at very high speed in principle. Therefore, by including sufficient capability of fixation as in the present invention, such an inkjet recording copier can demonstrate its full performance as a high-speed copier.

Figure 7:
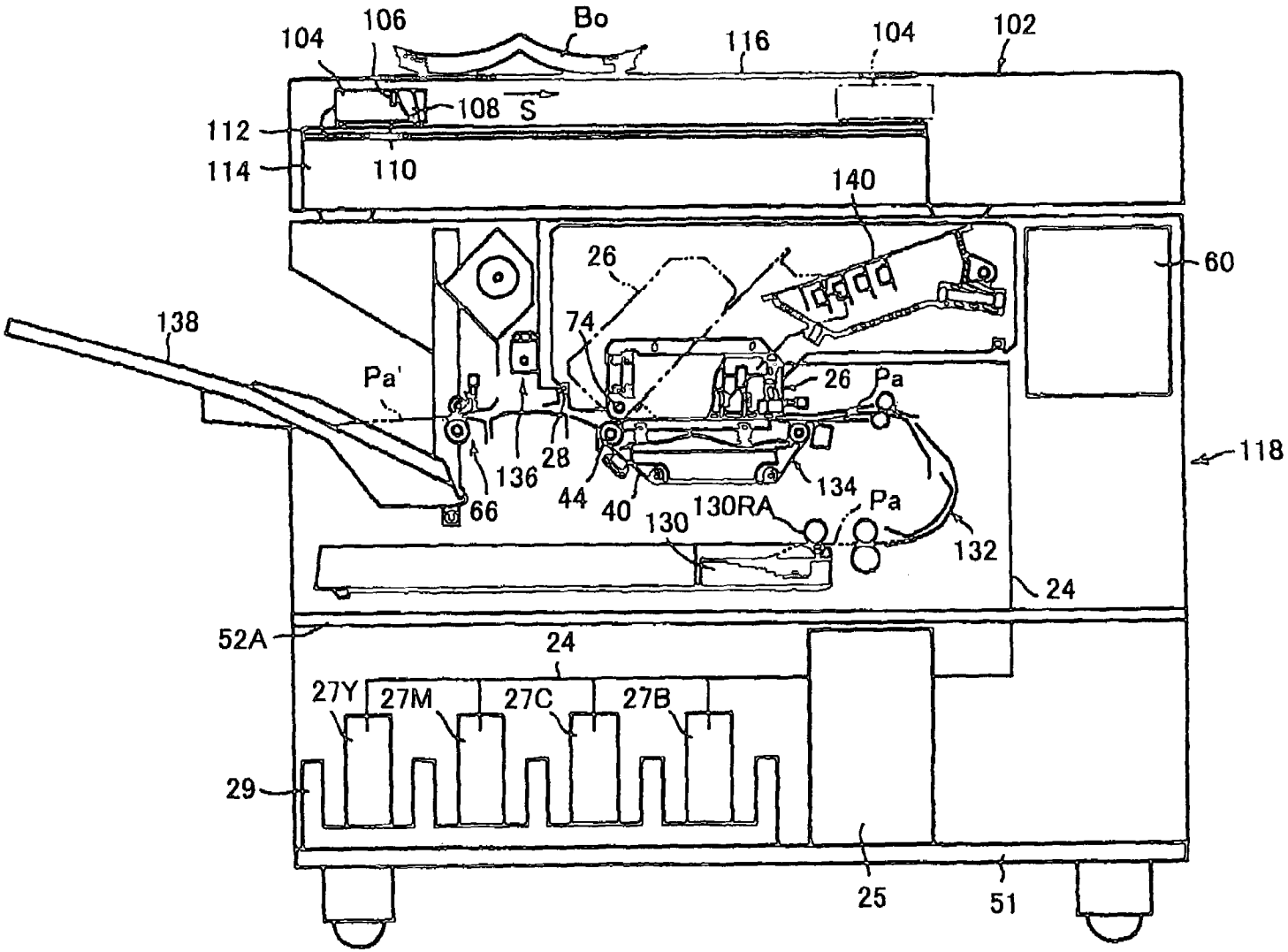
FIG. 7 is a sectional view of a variation of the color inkjet copier of FIG. 6 according to the present invention.
Figure 8:
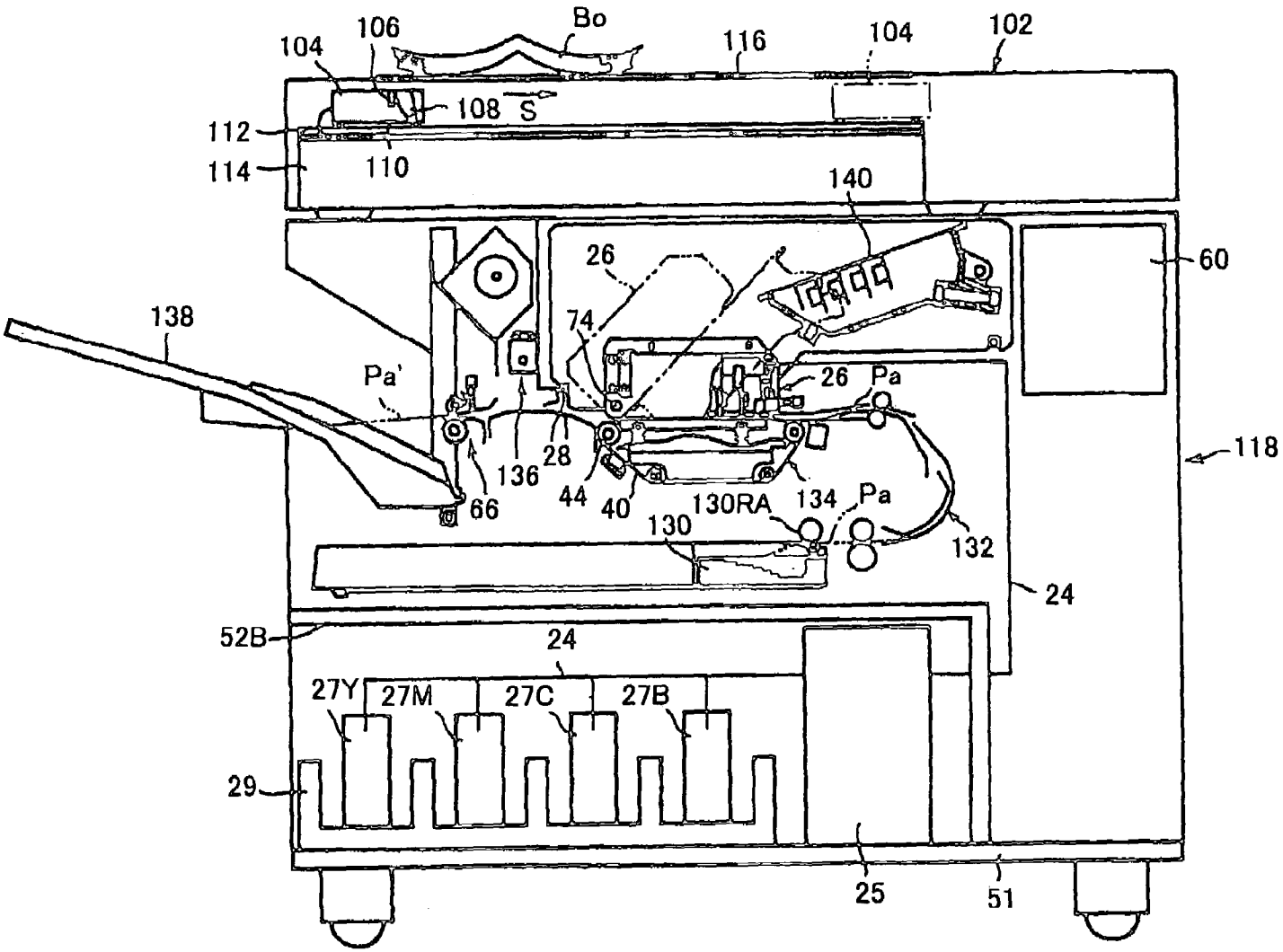
FIG. 8 is a sectional view of another variation of the color inkjet copier of FIG. 6 according to the present invention.

FIGS. 7 and 8 are diagrams showing variations of the color inkjet copier of FIG. 6 according to the present invention.

As previously described, the ink container 27 is provided at the bottom of the color inkjet copier so as to prevent the electrical system unit 60 and the scanner part 102 from being submerged (with ink) by an unexpected accident and thus from having damage or failure resulting from the submergence. FIGS. 7 and 8 show configurations such that the ink container 27 is separated from the electrical system unit 60 and the scanner part 102 with more certainty for further safety.

In the variation of FIG. 7, a first separation wall 52A (a separation part) is provided, and in the variation of FIG. 8, a second separation wall 52B (a separation part) is provided so that the ink container 27 is totally separated in a room from the rest of the color inkjet copier.

If the color inkjet copier has such a separation wall structure as shown in FIG. 8 that the ink container 27 is totally separated in a room, only part of the sidewall of the color inkjet copier which part corresponds to the room of the ink container 27 may be opened and closed in the case of supplying ink thereto or replacing any of the ink containers 27C, 27M, 27Y, and 27B. Therefore, ink can be supplied without unnecessarily opening and closing the other parts of the color inkjet copier. Accordingly, the electrical system unit 60 and the scanner part 102 can be protected with more certainty from an unexpected accident such as ink leakage or spouting. Further, ink supplying and container replacement can be performed easily according to this configuration.

In the variations of FIGS. 7 and 8, the pump 25 as well as the ink container 27 is separated from the other parts of the color inkjet copier. Since the pump 25 is separated by the separation part provided close thereto, the separation part can prevent or reduce damage caused by ink spouting even if ink should spout accidentally from the pump 25.

Further, in another aspect of the present invention, a bottom plate 51 is provided in each of the color inkjet copiers of FIGS. 6 through 8. Generally, in the configuration of an electrophotographic copier or printer, the bottom plate 51 is unnecessary if the rigidity of the apparatus can be maintained. In the present invention, however, since a large amount of ink is used, the bottom plate 51 is provided to prevent ink from dripping down to contaminate the floor in case ink leakage should occur. By thus providing the bottom plate 51, ink is prevented from dripping down to the floor even if ink leakage should occur. In addition, as shown in FIGS. 6 through 8, there is the advantage that the components and units of the recording apparatus and the copier of the present invention, such as the ink container 27, the ink container tray 29 holding the ink container 27, and the pump 25, can be provided on the bottom plate 51.

According to the present invention, the electrical system unit 60, which is vulnerable to water, is provided above the consumable ink container 27. Therefore, even if ink should leak accidentally from the ink container 27 at the time of, for instance, supplying ink thereto, the ink is prevented from damaging the electrical system unit 60. That is, the ink container 27 is provided at the bottom so as to prevent important parts of the multi-nozzle color inkjet recording apparatus or copier from being submerged (with ink) by an unexpected accident. Therefore, the multi-nozzle color inkjet recording apparatus and copier of the present invention can have increased reliability.

Further, the color inkjet recording apparatus and copier of the present invention, which consume a large amount of ink, are free of the shortage of ink supply to the multi-nozzle elongated recording heads 70C, 70M, 70Y, and 70B. In the conventional inkjet recording apparatus, ink is supplied by a capillary action without applying a special mechanical external force. On the other hand, since the color inkjet recording apparatus and copier of the present invention consume a large amount of ink, in order to supply a sufficient amount of ink to the multi-nozzle elongated recording heads 70C, 70M, 70Y, and 70B using the conventional method, it would be inevitable to lower the recording head driving frequency (ink droplet ejection frequency) and accordingly, decrease printing speed. However, according to the color inkjet recording apparatus and copier of the present invention, ink is supplied by using the pump 25. Therefore, a decrease in printing speed resulting from the shortage of ink supply can be avoided.

Further, according to the present invention, the ink container 27 is provided below the multi-nozzle elongated recording heads 70C, 70M, 70Y, and 70B in case of an unexpected accident. However, reduction in ink supply capability caused by positioning the ink container 27 below the recording heads 70C, 70M, 70Y, and 70B can be compensated for by supplying ink through the pump 25. Therefore, ink can be supplied effectively in the color inkjet recording apparatus and copier of the present invention.

Further, according to the present invention, the independent ink containers 27C, 27M, 27Y, and 27B are provided on the ink container tray 29, being separated from one another by the independent barriers thereof. Therefore, even if ink should leak from any of the ink containers 27C, 27M, 27Y, and 27B, the leaking ink is prevented from running around and spreading inside the apparatus. Accordingly, the color inkjet recording apparatus and copier can be free of internal contamination and failure in its electrical system caused by the leaking ink.

Further, according to the present invention, the ink container 27 may be isolated by the separation wall 52A or 52B. Therefore, even if ink should scatter accidentally from the ink container 27, the color inkjet recording apparatus and copier can be free of internal contamination and failure in its electrical system caused by the scattering ink.

Further, according to the multi-nozzle color inkjet copier of the present invention, the scanner part 102, which is vulnerable to water, is provided above the consumable ink container 27 and the multi-nozzle elongated recording heads 70C, 70M, 70Y, and 70B. Therefore, even if ink should leak accidentally from the ink container 27, or ink should spout in unexpected directions from any of the multi-nozzle elongated recording heads 70C, 70M, 70Y, and 70B, for instance, the ink is prevented from damaging the scanner part 102. Therefore, the multi-nozzle color inkjet copier of the present invention can have increased long-term reliability.

The present invention is not limited to the specifically disclosed embodiment, but variations and modifications may be made without departing from the scope of the present invention.

The present application is based on Japanese priority applications No. 2001-315893 filed on Oct. 12, 2001 and No. 2002-200745 filed on Jul. 10, 2002, the entire contents of which are hereby incorporated by reference.

What is claimed is:

1. A color inkjet recording apparatus comprising:

a plurality of multi-nozzle inkjet recording heads, wherein each recording head is elongated to cover a width of a recording medium, has thousands to tens of thousands of nozzles corresponding thereto arranged with densities of 400 to 2400 dpi, and ejects ink on demand at frequencies of a few to 30 kHz per nozzle, the multi-nozzle inkjet recording heads being arranged and fixed so as to eject a plurality of color inks supplied from an ink container provided below said multi-nozzle inkjet recording heads;

a separation part separating the color inkjet recording apparatus into a first region in which said ink container is provided and a second region in which the rest of the color inkjet recording apparatus is provided; and a holding part configured to hold the ink container, the holding part including a plurality of separation parts, wherein the recording medium includes a surface on which recording is performed and has the recording surface coated with particulate matter, the recording is performed by conveying the recording medium to a position that opposes surfaces of said multi-nozzle inkjet recording heads, said surfaces including the nozzles and ejecting ink droplets from the nozzles onto the recording surface of the recording medium, the ink container includes a plurality of independent ink containers containing the respective color inks, and the holding part holds the independent ink containers so that the independent ink containers are separated from each other.

2. The color inkjet recording apparatus as claimed in claim 1, wherein said separation part physically isolates said ink container in the color inkjet recording apparatus.

3. The color inkjet recording apparatus as claimed in claim 1, wherein said separation part separates said ink container from an electrical system unit controlling an operation of said color inkjet recording apparatus.

4. A color inkjet recording apparatus, comprising:

a plurality of multi-nozzle inkjet recording heads, wherein each recording head is elongated to cover a width of a recording medium, has thousands to tens of thousands of nozzles corresponding thereto arranged with densities of 400 to 2400 dpi, and ejects ink on demand at frequencies of a few to 30 kHz per nozzle, the multi-nozzle inkjet recording heads being arranged and fixed so as to eject a plurality of color inks;

an ink container supplying the color inks to said multi-nozzle inkjet recording heads, the ink container being provided below said multi-nozzle inkjet recording heads to be connected thereto through a communication part;

a separation part separating the color inkjet recording apparatus into a first region in which said ink container is provided and a second region in which the rest of the color inkjet recording apparatus is provided; and a holding pan configured to hold the ink container, the holding part including a plurality of separation parts, wherein recording is performed on a surface of the recording medium by conveying the recording medium to a position that is above said ink container and opposes surfaces of said multi-nozzle inkjet recording heads, said surfaces including the nozzles and ejecting ink droplets from the nozzles onto the recording surface of the recording medium, the ink container includes a plurality of independent ink containers containing the respective color inks, and the holding part holds the independent ink containers so that the independent ink containers are separated from each other.

5. The color inkjet recording apparatus as claimed in claim 4, wherein said separation part physically isolates said ink container in the color inkjet recording apparatus.

6. The color inkjet recording apparatus as claimed in claim 4, wherein said separation part separates said ink container from an electrical system unit controlling an operation of said color inkjet recording apparatus.

* * * * *